US005842079A

United States Patent [19]

Miyamoto et al.

[11] Patent Number: 5,842,079

[45] Date of Patent: Nov. 24, 1998

[54] FILM TYPE FIXING DEVICE

[75] Inventors: Kazuki Miyamoto; Naoyuki Ohki, both of Yokohama; Masaki Nakano, Ebina; Takahiro Ushiro; Yasuo Fukazu, both of Kawasaki; Atsushi Chaki, Yokohama; Shinichi Takata, Kawasaki; Kazuhiro Ohyoshi, Wakoh, all of Japan

[73] Assignee: Canon Kabushiki Kaisha, Tokyo, Japan

[21] Appl. No.: 842,052

[22] Filed: Apr. 23, 1997

Related U.S. Application Data

[63] Continuation of Ser. No. 542,786, Oct. 13, 1995, abandoned.

[30] Foreign Application Priority Data

Oct. 13, 1994 [JP] Japan ..... 6-247761

[51] Int. Cl.[6] ..... G03G 15/20

[52] U.S. Cl. ..... 399/33; 399/329

[58] Field of Search ..... 399/33, 162, 165, 399/329; 219/216; 432/59, 60

[56] References Cited

U.S. PATENT DOCUMENTS

| | | | |
|---|---|---|---|
| 5,153,655 | 10/1992 | Suzuki et al. | 399/329 |
| 5,157,444 | 10/1992 | Mori et al. | 399/329 |
| 5,157,446 | 10/1992 | Kusaka | 399/329 |
| 5,305,066 | 4/1994 | Koh et al. | 399/338 |
| 5,347,348 | 9/1994 | Nagata | 399/329 |
| 5,475,194 | 12/1995 | Watanabe et al. | 219/216 |

FOREIGN PATENT DOCUMENTS 0437204 7/1991 European Pat. Off. .

*Primary Examiner*—Arthur T. Grimley
*Assistant Examiner*—Sophia S. Chen
*Attorney, Agent, or Firm*—Fitzpatrick, Cella, Harper & Scinto

[57] ABSTRACT

A film type fixing device includes a rotatable endless film; film position detecting device for detecting a position, in a direction perpendicular to a rotational direction, of the film; error detecting device for detecting error of a position of the film when the output of the film position detecting device is out of a predetermined range; and discriminating device for discriminating whether to back up error information or not on the basis of the output of the film position detecting device, when the error detecting device detects the error.

9 Claims, 9 Drawing Sheets

FILM TYPE FIXING DEVICE

This application is a continuation, of application Ser. No. 08/542,786 filed Oct. 13, 1995, now abandoned.

FIELD OF THE INVENTION AND RELATED ART

The present invention relates to a fixing device using an endless film, more particularly to shift of film.

As disclosed in U.S. Pat. No. 5,157,444, a film type fixing device has been proposed which is constituted by a heater, a driving roller, a tension roller, and an endless film.

With such a device, the film tends to laterally shift, and therefore, the position of the film is detected by a sensor, and a tension roller is moved in response to the output of the sensor to control the shift of the film.

When the position of the film is extremely shifted, the abnormality of the film is stored as error information, and the fixing operation is prohibited. If this occurs, damage in the film is deemed as having been occurred, and therefore, a serviceman is called to repair the apparatus. Only then, the error information is reset to permit resumption of the fixing operation.

In the case of the device as disclosed in U.S. Pat. No. 5,157,444 wherein the position of the film is filmed on the basis of the rotation of the film, an erroneous detection may occur despite that the film has not yet been shifted to the limit, if the film does not rotate for some reason or another such as slip or the like. The error information is stored, and the fixing operation is prohibited, and therefore, the serviceman has to be called in order to reset the error information to permit the fixing operation, despite no damage to the film.

SUMMARY OF THE INVENTION

Accordingly, it is a principal object of the present invention to provide a film type fixing device wherein the error state is correctly detected to prevent unnecessary serviceman-calling.

It is another object of the present invention to provide a film type fixing device having controlling means for controlling a back-up operation for error information on the basis of an output of film position detecting means when the error detecting means detects the error on the basis of the position of the film.

These and other objects, features and advantages of the present invention will become more apparent upon a consideration of the following invention taken in conjunction with the accompanying drawings.

DESCRIPTION OF THE PREFERRED EMBODIMENT

Referring to the accompanying drawings, the embodiments of the present invention will be described.

Figure 1:
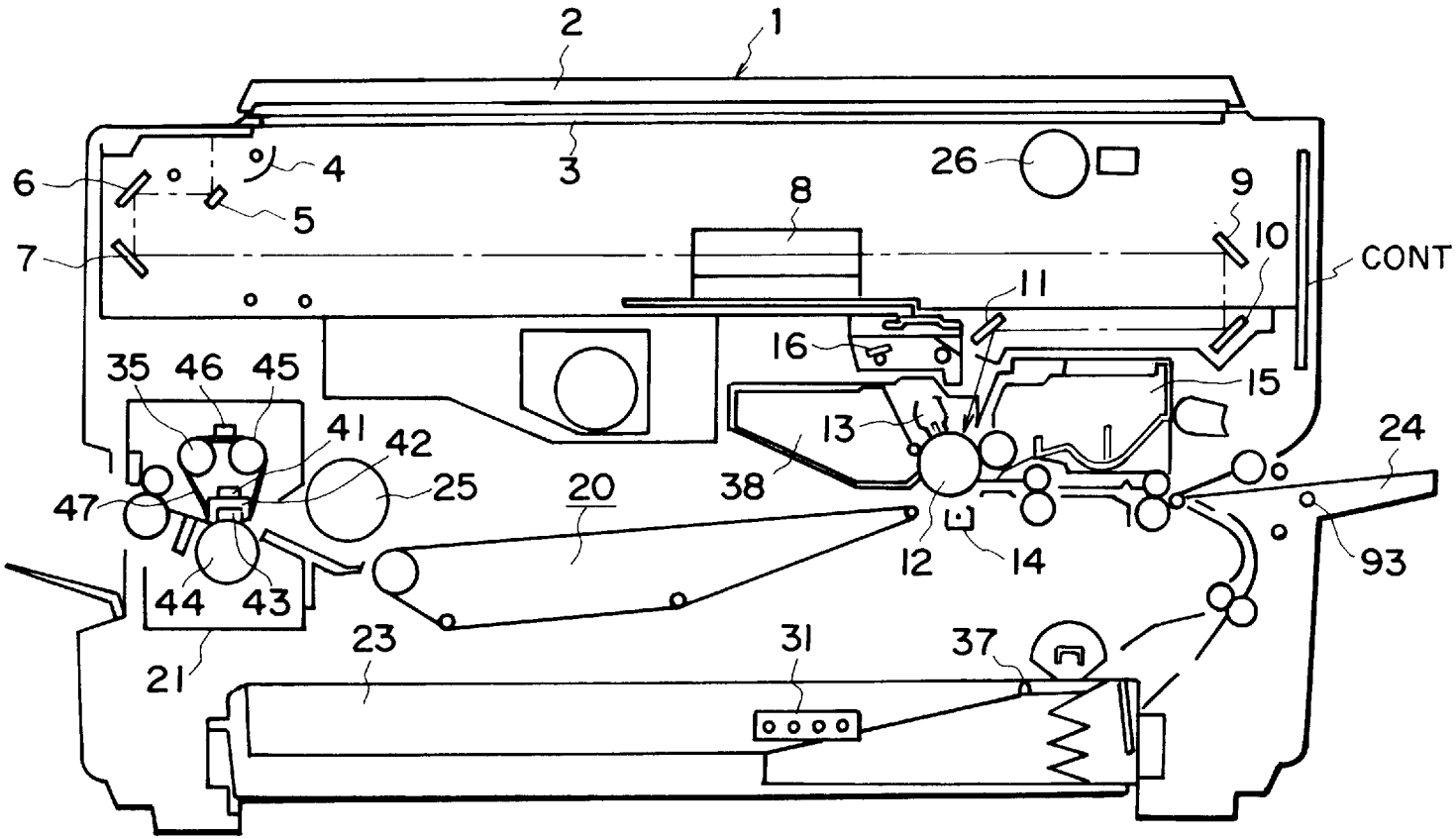
FIG. 1 is a sectional view of an image forming apparatus using a fixing device according to an embodiment of the present invention.

FIG. 1 is a sectional view of an image forming apparatus having a film type fixing device according to an embodiment of the present invention.

In FIG. 1, designated by 1 is a copying apparatus; 2 is a pressure plate; 3 is an original carriage for supporting an original; 4 is a light source; 5, 6, 7 are reflection mirrors; 8 is a lens; 9, 10, 11 are reflection mirrors; and 12 is a photosensitive drum.

Around the photosensitive member 12, there are provided a primary charger 13, a developing unit 15, a transfer unit 14, and a cleaning unit 38 and so on.

A fixing unit 21 functions to heat and fix an unfixed image while feeding a recording material coming form the photosensitive member side by the nip thereof.

In FIG. 1, the driving system is separated into a main driving system for driving a sheet feeding portion, a transportation portion, a photosensitive member, and a fixing portion and an optical driving system for driving the optical system which is a load. The main driving source uses a DC brush-less motor 25, and the optical driving source (including a mechanism for reading an image) uses a stepping motor 26. A controller (CONT) outputs a phase excitation signal applied in each phase A, A*, B. B* of the stepping motor 26. In this embodiment, the excitation driving type of the stepping motor 26 is switched between a two-phase excitation type and a 1-2-phase excitation type in accordance with speed information set for the load.

Sheet feeding type includes sheet feeding from a cassette 23 and a manual multi-feeding (24). In the case of the sheet feeding from the cassette 23, control is effected using a switch for detecting presence or absence of the cassette 23, switches 31 for detecting the size of the sheets in the cassette 23 and a switch 37 for detecting presence or absence of the sheet in the cassette 23. When abnormality is detected by the switches, the error is displayed on a display portion which will be described hereinafter.

In the case of multi- manual insertion, the control is effected using a switch 93 for detecting the state of the manual feeding station 24, and when an error is detected, it is displayed on a display portion which will be described hereinafter.

The photosensitive member 12 rotates in the clockwise direction on the drawing. The photosensitive member 12 is charged by the primary charger 13, and is exposed to the image light at the exposure station, and the resultant image is developed by a developing unit 15. The developed image is transferred onto a transfer sheet fed from the sheet feeding portion by the transfer unit portion 14. After transfer of the image, the photosensitive member 12 is cleaned by the cleaning unit 38 for removing the remaining toner, and the residual potential is removed by a pre-exposure lamp 16 to be prepared for the next image formation. The transfer sheet now having the transferred image is fed to the fixing unit 21 on a conveyer belt of the conveyer unit 20.

Figure 2:
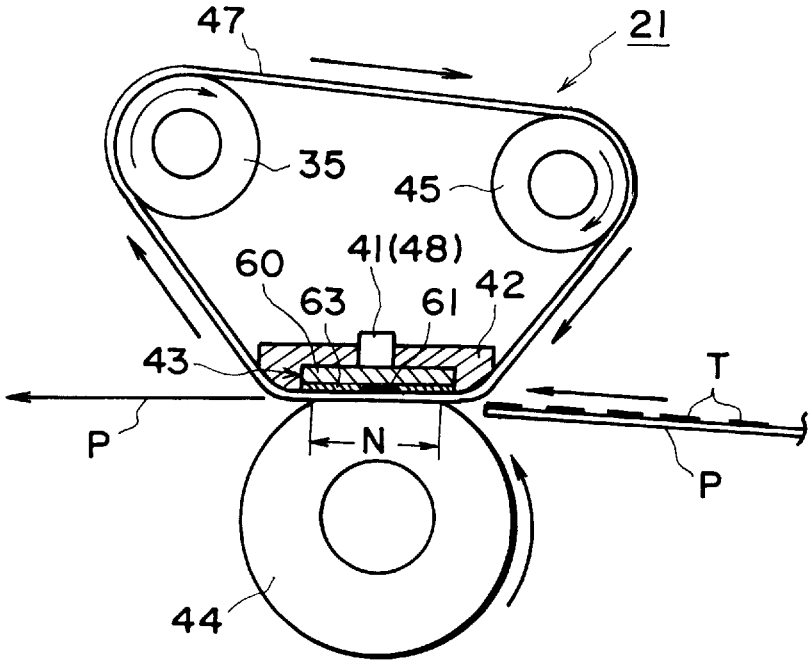
FIG. 2 is a sectional view of the fixing device.
Figure 3:
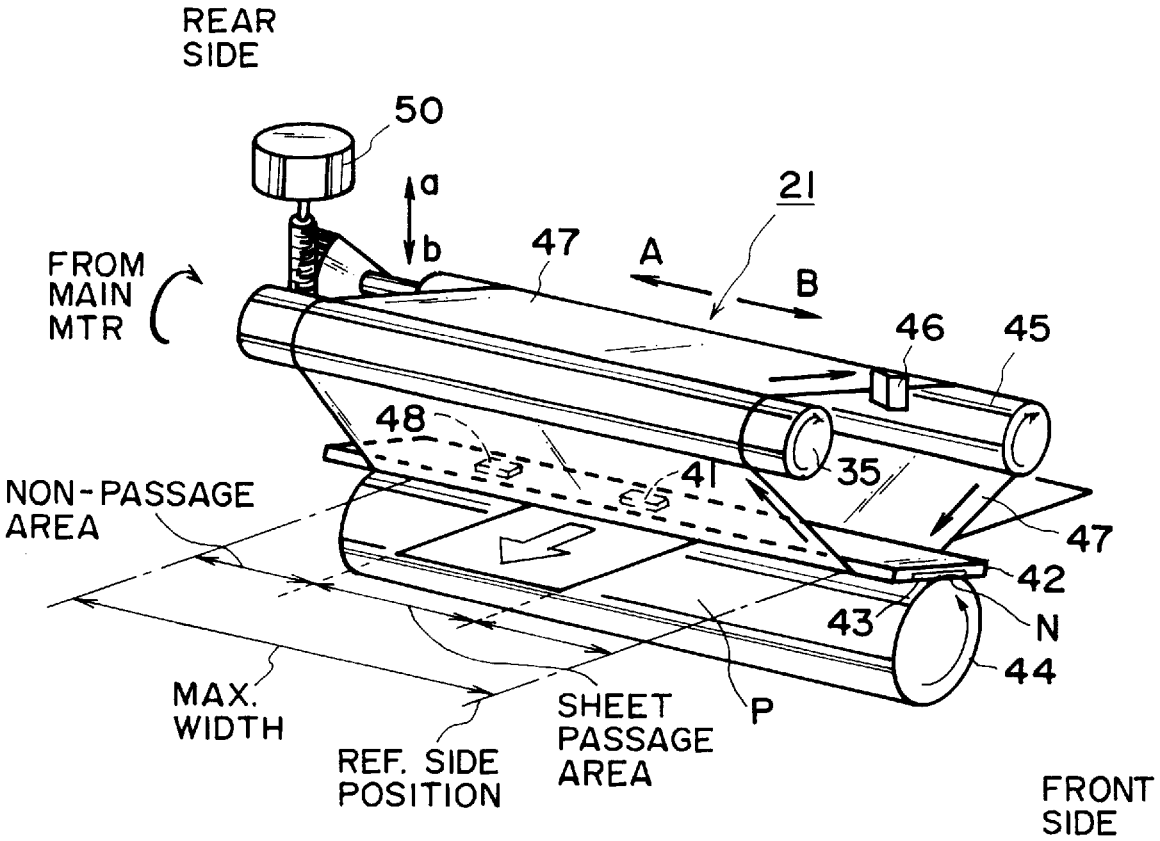
FIG. 3 is a perspective view of the fixing device.

The fixing unit 21 comprises a driving roller 35, a tension roller 45, and a pressing roller 44 (3 rollers), a heater 43, film 47 and so on. FIG. 2 and 3 show a construction of the fixing unit 21.

In these figures, an endless film 47 is extended around the driving roller 35, tension roller 45 and a heater 43, and the film 47 is driven by a driving roller 35 while keeping sliding contact with the heater 43.

The pressing roller 44 is urged to the heater 43 with the film 47 therebetween to form a nip N. The nip functions to feed the recording material P carrying an unfixed toner image T, while the unfixed toner image T is being fixed on the recording material by the heat from the heater 43 through the film 47.

Designated by 41 is a temperature detection element in the form of a thermistor or the like, and is contacted to the back side of the heater 43 directly. Another temperature detection element 48 is mounted on the back side of the heater 43 similarly to the temperature detection element 41. The temperature detection element 48 is mounted to the heater 43 adjacent an end portion thereof. This is because if a small size sheet is fed, the temperature rises in the portion where the sheet does not exist, and the interval of the sheet feeding is expanded on the basis of the detection of this temperature.

Referring to FIG. 3, a sensor 46 detects the position of the film in a direction perpendicular to the rotational direction. In accordance with the output of the sensor, the motor 50 is driven, in response to which the tension roller 45 is inclined to control the shift of the film.

Figure 4:
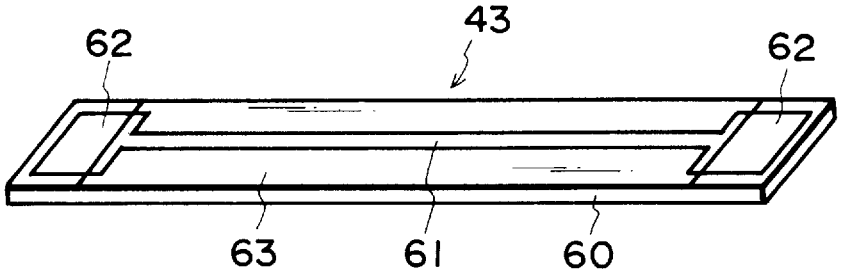
FIG. 4 is an illustration of a heater.

FIG. 4 shows a structure of the heater which comprises a ceramic substrate 60, a resistor 61 printed thereon and an electrode 62 adjacent an end portion thereof.

The resistor 61 is supplied with electric energy by the electrodes 62 at the opposite ends so that the resistor 61 generates heat.

Designated by 63 is a protection layer of glass or the like on the resistor 61.

The heater 43, as shown in FIG. 2, is supported on a heat resistivity plastic resin material supporter 42.

Figure 5:
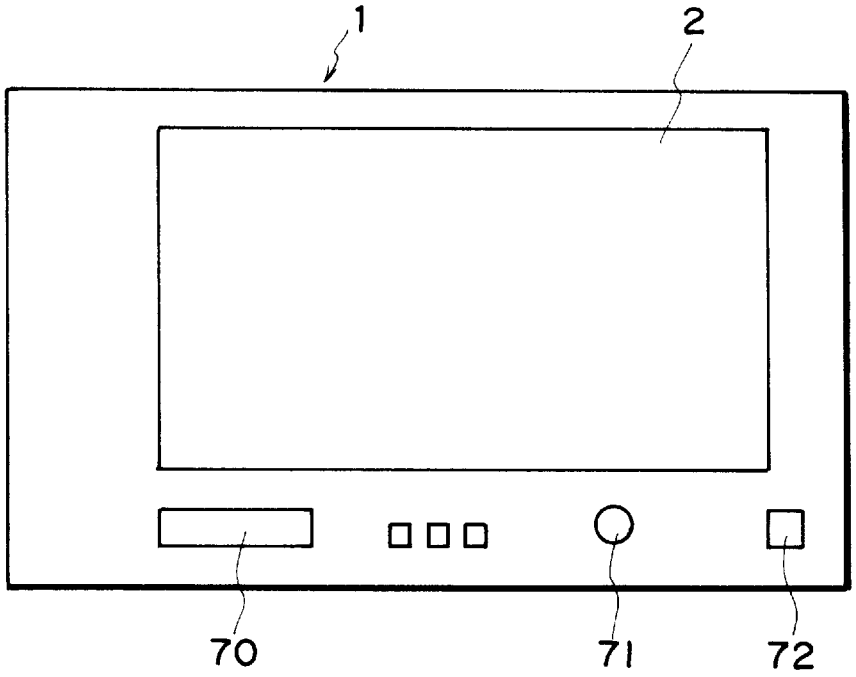
FIG. 5 Is a top plan view of an image forming apparatuses.
Figure 6:
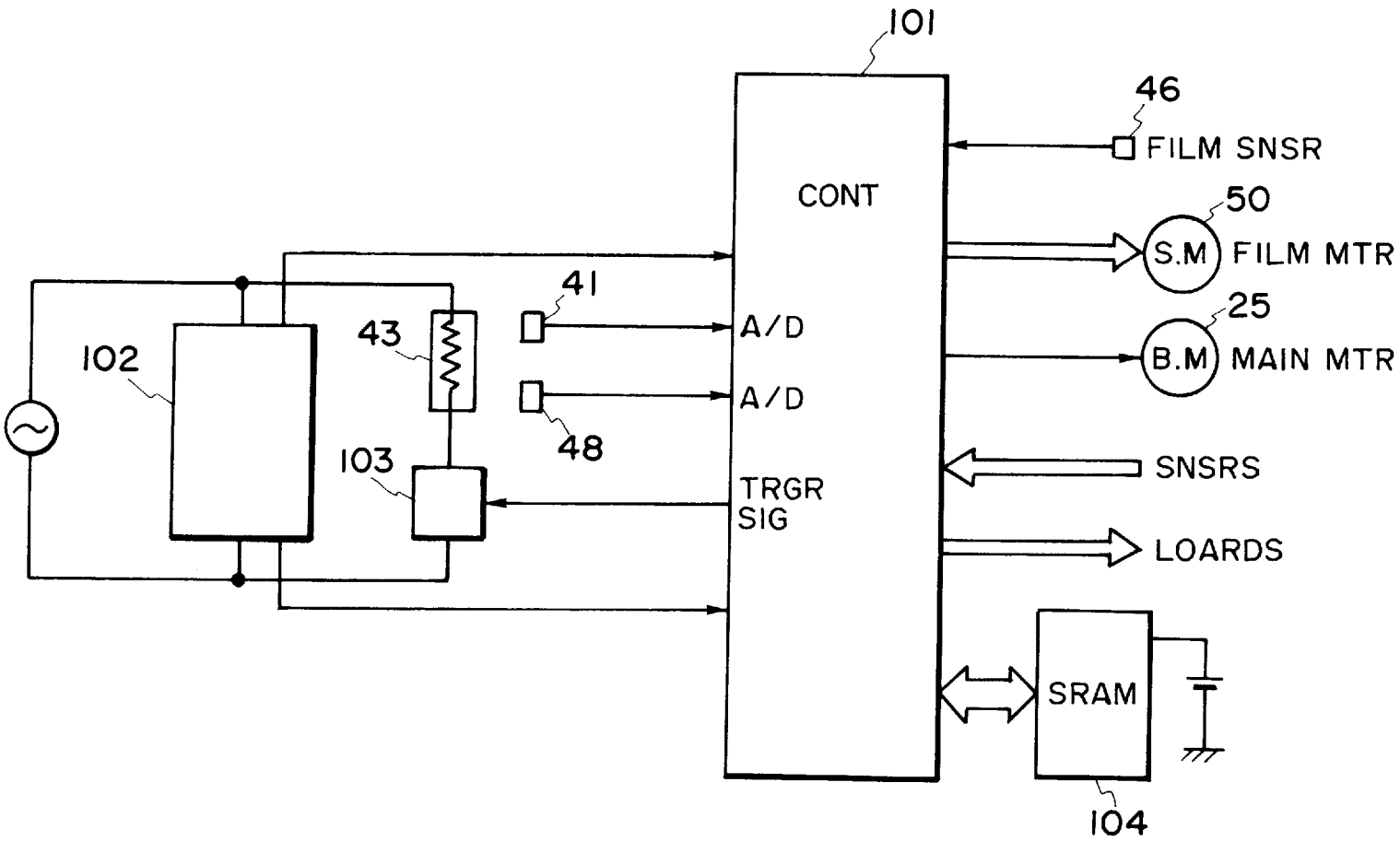
FIG. 6 is an image forming apparatus of the image forming apparatus.

FIG. 5 is a schematic top plan view of the device of FIG. 1 as seen from the top wherein 70 is a display portion for displaying messages such as error messages; 71 is a copy key, for starting copy operation; and 72 is a main switch for ON-OFF control of the voltage supply to the device Referring to FIG. 6, the description will be made as to operation of the device.

Designated by 101 is a controller, for temperature control for the fixing device, for the electric power control and for the shift control etc. for the film, and 102 is a circuit for detecting the voltage of the voltage source and input voltage. Designated by 103 is a switching circuit for switching the voltage applied to the heater 43, and 104 is memory for storing various data.

The controller 101 supplies the AC input corrected voltage from the input voltage detection circuit 102 to the A/D of the controller 101. This is an execution value Erms of the input voltage. The output of thermistors 41, 48 are supplied to the A/D of the controller 101. The resistance value of the heater 43 has beforehand measured under the normal temperature ambience condition, and is displayed on the fixing unit 21 The resistance value is supplied to the memory 104 by an operating portion (unshown).

On the basis of the AC input, zero-cross signal is produced, and is supplied to the controller 101 as an interruption signal.

A trigger signal functions as a timing signal for phase control of the heater. Designated by 46 is a sensor (photo-interrupter) as a film position detecting means for detecting the position of the film in the direction perpendicular to the movement direction of the film, and the film motor 50 drives or shifts up and down the tension roller 45 on the basis of the output of the sensor The description will be made as to the control of the heater. The heater is provided by printing resistor material on the ceramic substrate, as has been described, and therefore, is excellent in the heat responsivity. Therefore, in a normal ON/OFF control, the ripple relative to the target temperature if the use is made with the normal ON/OFF control, or the heater may be overpowered with the possible result of the damage to the heater. Therefore, an electric power control is used to supply a constant electric power. In order to reduce the ripple, the electric power is changed over in response to the temperature detected by thermistor, The description will be made as to the electric power control for the heater. The phase control is used also for the electric power control for the heater similarly to the control for the exposure lamp. The heater is a pure resistance load, and therefore, the electric power W is:

$W=V_H^2/R$ $V_H$: voltage applied to the heater

R: resistance value of the heater.

Since the resistance value R of the storing varies significantly, the resistance value R is stored in a non-volatile memory for individual image forming apparatus. The electric power to be supplied to the heater is known, and therefore, the voltage VH across the heater is determined from the above equation, as follows:

$$V_H^2 = \sqrt{\left(\int_{T_H}^{T/2} E^2\mathrm{rms}\,\sin_2(2\pi/T)t\,dt\right)/T/2} \tag{2}$$

$$V_H^2 = E^2\mathrm{rms}(1 - 2T_H/T + (1/2\pi)\sin(4\pi T_H/T)$$

$$E\mathrm{rms}^2/V_H^2 = 1/\{1 - 2 \times T_H/T + \sin(4\pi T_H/T)/2\pi\}$$

From formula (1), $V_H^2$ is calculated, and $\mathrm{Erms}^2$ is obtained from the value detected by the AC input voltage detection circuit. Then, the time period TH from the zero-cross signal to the trigger signal for the heater can be determined, from formula (2).

In this embodiment, $T_H$ is determined from $\mathrm{Erms}^2/V_H^2$ using a table.

Through the algorithm described hereinbefore, the electric power control for the heater is carried out. The electric power control for the heater is kept always during copy operation to maintain a constant temperature of the heater.

The description will be made as to the shift control for the film.

Figure 7:
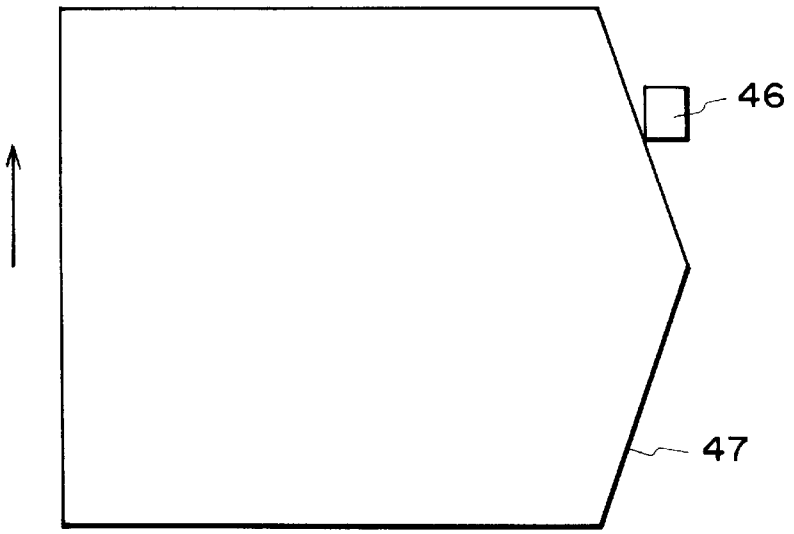
FIG. 7 is a development of an endless film.

FIG. 7 is a development of the endless film 47. As shown in the Figure, one of the lateral end of the endless film 47 is cut inclinedly (bias cutting) to provide inclined portion. This is done to detect the lateral shift of the film. A sensor (photo-interrupter) is provided on the apparatus at the side. where the film has the bias cutting portion. When the receiving portion detects the light from the emitting portion, a low-level signal is produced, and, when the light from the emitting portion is blocked by the film, the high-level signal is produced, by the use of the photo-interrupter 46

Figure 8:
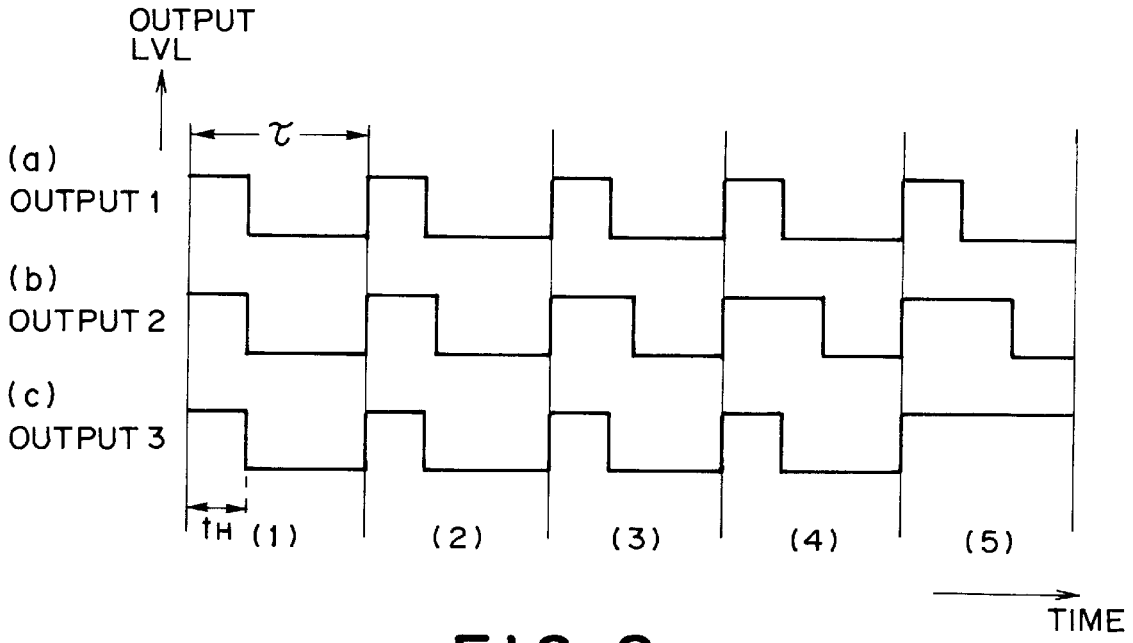
FIG. 8 shows an output waveform from a film sensor.

The relation between the shift of the endless film 47 and the output of the photo-interrupter 46, will be described. Since the lateral side of the film 47 is cut inclinedly, the output of the photo-interrupter 46 is as shown in FIG. 8 when the film 47 rotates in the direction indicated by the arrow through one full turn. When the position of the film does not change, the output from the photo-interrupter 46 has a constant duty ratio (ratio of the time periods producing the high level and the low level). A period τ corresponds to the time period for the film one full turn. With the deviation of the film position, the duty ratio changes in accordance-with the deviation, as shown in FIG. 8, (b).

More particularly, when the film 47 approaches to the photo-interrupter 46, the time of the high-level output is long, and when the film 47 is remote from the photo-interrupter 46, the time of high-level output is short.

Figure 9:
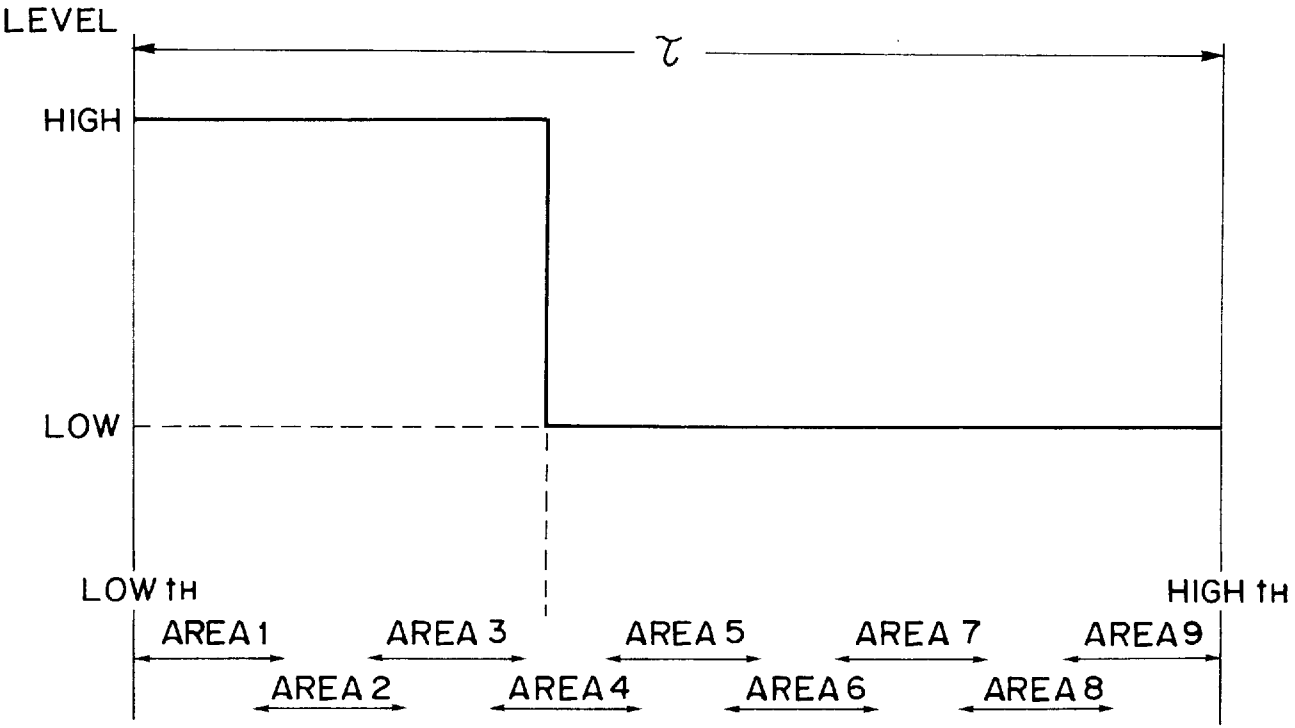
FIG. 9 shows division of region of the output waveform from the film sensor.

The one period τ is divided equally into a plurality of parts (9 parts in this embodiment), and the adjacent parts are slightly overlapped (FIG. 9). The duty ratio of the film sensor output is detected, and it is determined on which region or area the detected value falls. In FIG. 9, the duty ratio falls in an area 4. The duty ratio of previous detection is stored in the memory 104. When the detected value falls in the overlapping area, the area selected in the previous detection is selected. In other words, hysteresis characteristics are provided. By this, too sensitive response of the control is avoided.

As to the shift control method for the film, the film motor 50 is driven so that the movement direction of the endless film 47 reverses for each change of the area. Referring to FIG. 3, the description will be made as to the position of the tension roller 45 and the movement direction of the endless film 47. If the side of the tension roller 45 driven by the film motor 50 takes an upper position a, (film motor 50 direction is rotational direction CCW), the endless film 47 moves toward the film motor 50 side A(rear side). Conversely, if the tension roller 45 takes the lower position b (rotational direction CW), the endless film 47 moves toward the B side (front side). Table 1 shows the relation between the duty ratio (region) change by the film sensor 46 and the rotational frequency of the film motor 50.

TABLE 1

| AREA CHANGES | NO. FILM MTR ROTATIONS | DIRECTION |
|---|---|---|
| 2 to 1 | 6 | CW |
| 3 to 2 | 3 | CW |
| 4 to 3 | 3 | CW |
| 5 to 4 | 3 | CW |
| 5 to 6 | 3 | CCW |
| 6 to 7 | 3 | CCW |
| 7 to 8 | 3 | CCW |
| 8 to 9 | 6 | CCW |

Thus, in this embodiment, the shift state of the film is not known unless the endless film 47 is rotated. When the shift control is carried out, the film is necessarily rotating, and if the main motor stops during rotation of the film motor 50, the film stops. In this case, the rotation of the film motor is interrupted, and the rest of the rotation of the film motor is carried out upon the next time film rotation This is in order to avoid production of crease, since otherwise (if only the tension roller is driven when the film is at rest), the film is creased.

Figure 10:
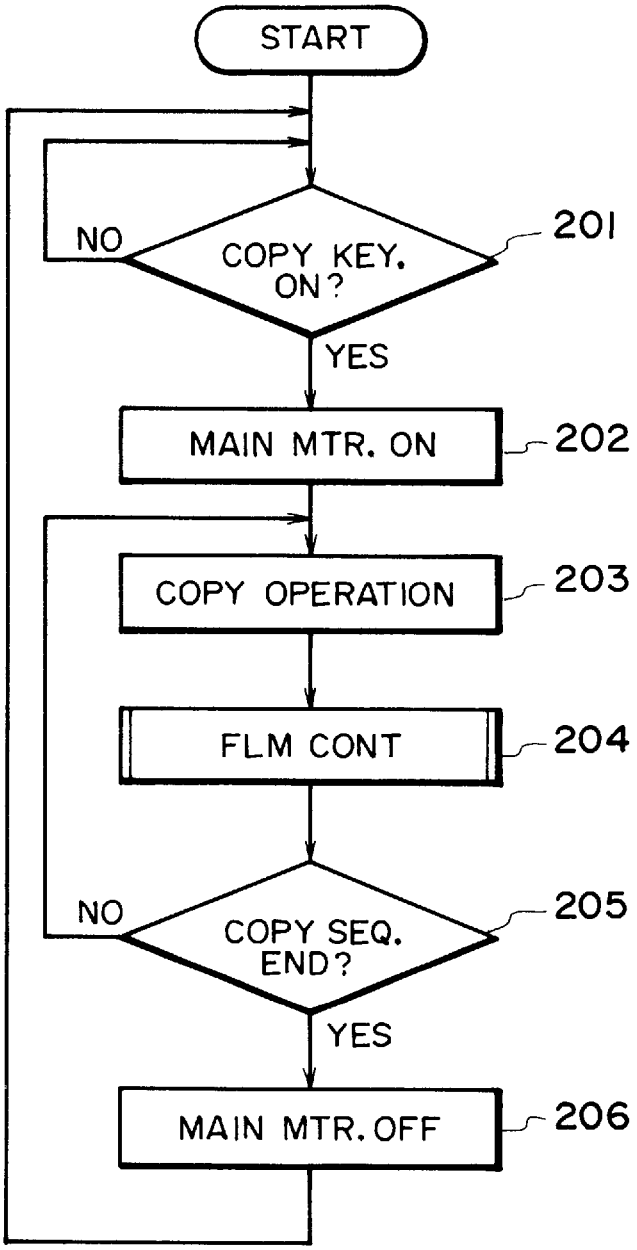
FIG. 10 is d main routine flow chart for image formation.
Figure 11:
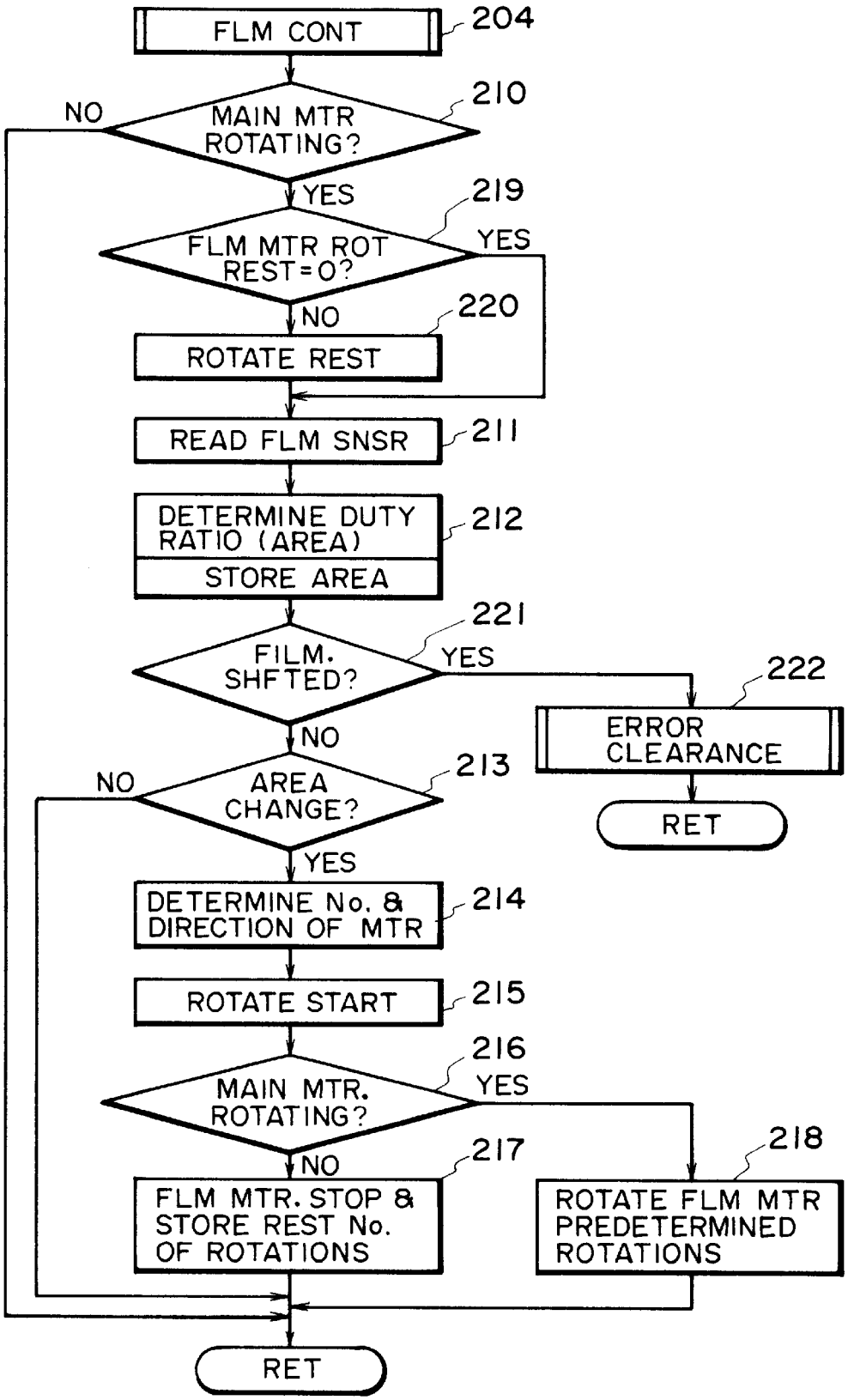
FIG. 11 is a flow chart for the film shift control.
Figure 12:
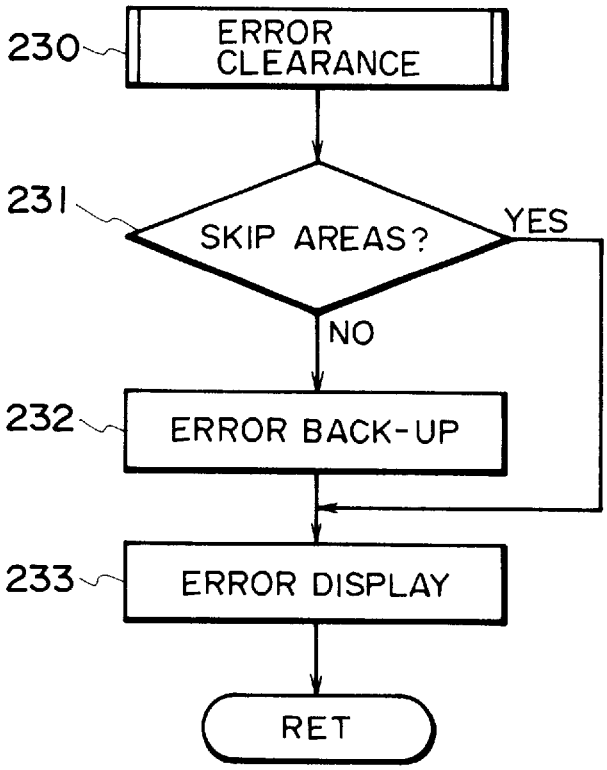
FIG. 12 is a flow chart for error clearance

Referring to the flow chart of FIGS. 10, 11, and 12, the sequence of operation, mainly of the operation related to the shift of the film. When the copy key is depressed in FIG. 10 (201), the main motor 29 for driving the photosensitive member and the fixing device is rotated (202). Sequentially, the copy sequence is carried out (203) to execute a film shift control routine (204). The confirmation is made as to whether the copy sequence is completed or not, and if not, the operation goes back to the copy process routine (203)–(205). If the copy sequence is completed, the main motor 25 is stopped (206). Referring to FIG. 11, film shift control will be described. In the film shift control routine (204), it is checked whether the main motor is rotating or not (210). This is carried out to permit film shift control only during the main motor rotation. When the rotation of the main motor is confirmed, it is confirmed whether or not there is the rest of the rotational frequency of the film motor, namely, whether or not the film motor was rotating upon the stop of the previous main motor rotation (219). If so, it is rotated through the rest rotational frequency. Then, the output of the film sensor is read in (211), and the duty ratio (region) is determined, and-the region is stored (212). The discrimination is made as to whether or not the film is completely shifted. If so, the error clearance (222) is carried out, and this is the end of this routine. If the film is not completely shifted, the comparison is made between the area stored, and the current area. Then, it is determined whether a change occurs or not (213). If so, the rotation and rotational direction of the film motor is determined (214), and the film motor is rotated accordingly (215). The discrimination is made again as to whether the main motor is rotated or not, and if so, the film motor is rotated through a predetermined number of turns. If the main motor was stopped, the film motor is immediately stopped, and the rest of the rotations of the film motor is stored (217). This is the end of this subroutine.

In this embodiment, when all of the outputs of the sensor 46 are High level or Low level, it is discriminated that the output from the sensor 46 is out of the predetermined range (area 1–9), and therefore, an error signal is produced. The error detection is effected by a controller including an error detecting means.

Referring to FIG. 12, error clearance (230) upon production of the error information will be described.

In this embodiment, when the error isdetected by the error detecting means, the storing of the error information is selected by controller on the basis of the output of the film position detecting means (sensor).

Referring to FIG. 12 the error clearance (230) will be described. The area previously stored and the current area are compared in order to discriminate whether the error is reached as a result of gradual change at a rate not more than a predetermined rate or the error is resulted from change at a rate more than a predetermined rate and skipping an area (231).

For example, if the error occurred as a result of change skipping one or more areas, as indicated by (5) in FIG. 8, (c), it is discriminated as an error resulting from complete shift of the film, and therefore, it is not stored in the memory, but the error display is carried out on the display portion to notify the occurrence of the error (233), and the error clearance routine is finished. When the error occurs as a result of gradual change, it is discriminated that the control of the film shift becomes unable, and the error is stored in the memory, and the error display is carried out and prohibit the image forming operation including the fixing operation to prevent the copy operation.

The error information stored in the memory is not reset even by the OFF/ON of the voltage source switch. In order to clear the error, a serviceman has to be called (serviceman-calling), and the error is cleared by maintenance operation of the serviceman.

The error information not stored, is cleared by OFF/ON of the voltage source switch, and the copy start is possible thereafter. Accordingly, in this Embodiment, when the error information is not stored, a display prompting rest of the voltage source is given as well as the error display on the display portion.

The stored or backed-up state means that the information (error information) is not cleared even by the OFF/ON of the voltage source, and the non-stored or non-backed-up information (even if it is once memorized) means that it is not cleared even by the OFF/ON of the voltage source.

As described in the foregoing, the storing of the error information is controlled on the basis of the output of the film position detecting means, and therefore, if the film stick or the like, the production of the error information despite the correct position of the film can be avoided, so that unnecessary serviceman calling can be avoided In this embodiment, 1 period is divided into 9 areas, but it may be divided into a larger number of parts, and the limit number of skipped areas may by two or more.

In this embodiment, the OFF/ON of the voltage supply is carried out by the voltage source switch (main switch), but the rest switch may be provided in addition to the voltage source switch, and may be used for clearing the error not stored or back-ed up.

While the invention has been described with reference to the structures disclosed herein, it is not confined to the details set forth and this application is intended to cover such modifications or changes as may come within the purpose of the improvements or the scope of the following claims.

What is claimed is:

1. A film type fixing device, comprising:

a rotatable endless film;

film position detecting means for detecting a position, in a direction perpendicular to a movement direction, of said film;

error detecting means for detecting error of a position of said film when the output of said film position detecting means is out of a predetermined range; and discriminating means for discriminating whether to back up error information or not on the basis of the output of said film position detecting means, when said error detecting means detects the error, wherein the backed-up error information is not cleared by an absence of voltage supply to said device for a predetermined period, and non-backed up error information is cleared by the absence of voltage supply for the predetermined period.

2. An apparatus according to claim 1, wherein when the output of said film position detecting means detects the error as a result of change at a rate less than a predetermined rate, the error information is backed up, and wherein when the output of the film position detecting means detects the error as a result of change at a rate not less than the predetermined rate, the error information is not backed up.

3. An apparatus according to claim 1, further comprising film position storing means for storing the output of said film position detecting means.

4. An apparatus according to claim 1, wherein said film position detecting means detects the position of the film by predetermined rotation of said film.

5. An apparatus according to claim 4, wherein said film has an inclined portion at an end portion thereof, and said film position detecting means detects presence or absence of a portion of said film at the inclined portion.

6. An apparatus according to claim 1, wherein the rest of the voltage supply is carried out automatically in response to OFF/ON of a voltage source switch of said apparatus.

7. An apparatus according to claim 1, further comprising error information storing means for storing the error information.

8. An apparatus according to claim 1, further comprising a heating element inside said endless film, wherein an unfixed image is fixed on a recording material by heat from said heating element through said film.

9. An apparatus according to claim 8, further comprising a pressing member for press-contacting said film to said heating element.

* * * * *

UNITED STATES PATENT AND TRADEMARK OFFICE

CERTIFICATE OF CORRECTION

PATENT NO. : 5,842,079

DATED : November 24, 1998

INVENTOR(S) : KAZUKI MIYAMOTO, ET AL.

It is certified that error appears in the above-identified patent and that said Letters Patent is hereby corrected as shown below:

COLUMN 1,
Line 60, "tuses." should read --tus.--.

COLUMN 2,
Line 1, "d" should read --a--;
Line 21, "form" should read --from--;
Line 45, "multi- manual" should read --multi-manual--; and
Line 66, "FIG. 2" should read --FIGS. 2--.

COLUMN 3,
Line 59, "unit 21" should read --unit 21.--.

COLUMN 4,
Line 28, "VH" should read --$V_H$--;
Line 41, "TH" should read --$T_H$--;
Line 52, "end" should read --ends--; and
Line 61, "photo-interrupter 46" should read --photo-interrupter 46.--.

COLUMN 5,
Line 7, "to the" should read --the--; and
Line 33, "change" should read --changed--.

UNITED STATES PATENT AND TRADEMARK OFFICE

CERTIFICATE OF CORRECTION

PATENT NO. : 5,842,079

DATED : November 24, 1998

INVENTOR(S) : KAZUKI MIYAMOTO, ET AL.

It is certified that error appears in the above-identified patent and that said Letters Patent is hereby corrected as shown below:

COLUMN 7,
Line 14, "by" should read --be--; and
Line 19, "back-ed up" should read --backed-up--.

COLUMN 8,
Line 23, "rest" should read --absence--.

Signed and Sealed this

Thirteenth Day of July, 1999

*Attest:*

*Attesting Officer*

Q. TODD DICKINSON

*Acting Commissioner of Patents and Trademarks*